US010591832B2

(12) United States Patent
Srinivasan et al.

(10) Patent No.: US 10,591,832 B2
(45) **Date of Patent: *Mar. 17, 2020**

(54) CRASH COOLING METHOD TO PREPARE TONER

(71) Applicant: LEXMARK INTERNATIONAL, INC., Lexington, KY (US)

(72) Inventors: Kasturi Rangan Srinivasan, Longmont, CO (US); Anna Sara McLeland, Colorado Springs, CO (US); Rahel Bekru Bogale, Firestone, CO (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/385,325

(22) Filed: Apr. 16, 2019

(65) Prior Publication Data

US 2019/0243264 A1 Aug. 8, 2019

Related U.S. Application Data

(63) Continuation-in-part of application No. 16/373,766, filed on Apr. 3, 2019, which is a continuation of application No. 15/629,018, filed on Jun. 21, 2017, now Pat. No. 10,108,100.

(51) Int. Cl.

| | |
|---|---|
| ***G03G 9/08*** | (2006.01) |
| ***G03G 9/087*** | (2006.01) |
| ***G03G 9/093*** | (2006.01) |
| *G03G 15/10* | (2006.01) |

(52) U.S. Cl.

CPC ..... *G03G 9/08797* (2013.01); *G03G 9/0802* (2013.01); *G03G 9/0804* (2013.01); *G03G 9/0806* (2013.01); *G03G 9/08711* (2013.01); *G03G 9/08755* (2013.01); *G03G 9/09328* (2013.01); *G03G 9/09364* (2013.01); *G03G 9/09371* (2013.01); *G03G 9/09378* (2013.01); *G03G 9/09385* (2013.01); *G03G 9/09392* (2013.01); *G03G 9/08704* (2013.01); *G03G 9/08775* (2013.01); *G03G 15/104* (2013.01)

(58) Field of Classification Search

CPC ... G03G 9/0802; G03G 9/0804; G03G 9/0806
USPC ..... 430/137.14
See application file for complete search history.

(56) References Cited

U.S. PATENT DOCUMENTS 10,108,100 B1 * 10/2018 Srinivasan ..... G03G 9/08797

* cited by examiner

*Primary Examiner* — Mark A Chapman

(57) ABSTRACT

The present disclosure relates generally to a method to make a chemically prepared toner that employs a crash cooling process. In the crash cooling process, hot toner slurry is added to an external reactor containing a coolant comprised of previously cooled toner slurry in combination with cooled de-ionized water. The previously cooled toner slurry found in the coolant has the same toner composition as the incoming hot toner slurry. Also, the amount of the coolant in the external reactor is equivalent to the amount of incoming hot toner slurry. Polyester toners and polyester core shell toners having a borax coupling agent between the toner core and toner shell made from this crash cooling process results in an improvement to the toner performance especially a decrease in the overall toner usage.

7 Claims, 2 Drawing Sheets

CRASH COOLING METHOD TO PREPARE TONER

CROSS REFERENCES TO RELATED APPLICATIONS

This application claims priority as a continuation is part of U.S. patent application Ser. No. 16/373,766, filed Apr. 3, 2019, having the same title which is a continuation of U.S. Pat. No. 10,108,100, issued Oct. 23, 2018, having the same title.

BACKGROUND

Field of the Disclosure

The present invention relates generally to a method to produce chemically prepared toners for use in electrophotography and more particularly to a method for preparing a chemically prepared toner using a crash cooling step wherein hot toner slurry is added to an external reactor containing a coolant comprised of previously cooled toner slurry in combination with cooled de-ionized water. The previously cooled toner slurry found in the coolant has the same toner composition as the incoming hot toner slurry. Also, the amount of the coolant in the external reactor is equivalent to the amount of incoming hot toner slurry.

Description of the Related Art

Toners for use in electrophotographic printers include two primary types, mechanically milled toners and chemically prepared toners (CPTs). Chemically prepared toners have significant advantages over mechanically milled toners including better print quality, higher toner transfer efficiency and lower torque properties for various components of the electrophotographic printer such as a developer roller, a fuser belt and a charge roller. The particle size distribution of CPTs is typically narrower than the particle size distribution of mechanically milled toners. The size and shape of CPTs are also easier to control than mechanically milled toners.

One process for preparing a CPT is by emulsion aggregation. Emulsion aggregation is carried out in an aqueous system resulting in good control of both the size and shape of the toner particles. The toner components typically include a polymer binder, one or more colorants and a release agent.

Known crash cooling processes for preparing a CPT by emulsion aggregation involve the addition of cooling water, in particular chilled water, following a toner rounding step and prior to filtration, in what is called a crash cooling step. A known crash cooling method adds an amount of cooling water that is equivalent to the amount of reactor batch of toner placed in an external reactor. This method of crash cooling unfortunately limits the quantity of toner that can be produced from a single reactor batch. In an alternate crash cooling method, the hot toner slurry is placed into an external reactor having an equivalent amount of de-ionized water that has been cooled from about 7° C. to about 25° C. Toners cooled by these crash cooling methods can have either non-uniform crystalline domains (adding cold water to hot toner slurry) or more uniform crystalline domains (adding hot toner to cold water). However, cooling of the toner by the above techniques requires an equivalent amount of de-ionized water and therefore uses a large quantity of cooled de-ionized water for making and cooling the toner. Another crash cooling method puts hot toner slurry into a reactor containing ice. Unfortunately, the crash cooling by this method results in non-uniform crystalline domains, and variability in the crystalline domains across the toner batch. As may be envisioned by adding hot toner slurry (for example 80° C.) to an ice bath would result in rapid cooling for the initial batch of toner and as the ice melts and temperature increases, the latter half of the toner batch would see a slower cooling rate. Accordingly, an alternate method to cool toner using a reduced amount of de-ionized water is preferred both in terms of being more cost effective and more environmentally friendly. Additionally, the crash cooling method of the present invention also increases overall productivity, by utilizing a small amount of a previous cooled batch of toner slurry as a coolant medium for the newer batches of toner being manufactured.

SUMMARY

A crash cooling method for producing toner for electrophotography according an embodiment, includes combining and agglomerating a polymer latex with a pigment dispersion and a wax dispersion to form toner particles, the toner particles being suspended in a aqueous medium, thereby forming a toner slurry. Once the toner particles reach a predetermined size, the temperature is elevated, and once the toner particles reach a predetermined circularity, the hot toner slurry is added a coolant in an external reactor to crash cool the toner particles in the toner slurry. The coolant in the external reactor comprises a mixture of cooled de-ionized water and previously crash cooled toner slurry. The previously cooled toner slurry in the coolant mixture has the same composition as the incoming hot toner slurry. The ratio of the cooled de-ionized water and previously crash cooled toner slurry is between 98:2 by weight and 60:40 by weight, preferably 70:30 by weight. The amount of coolant in the external reactor used to cool the incoming hot toner slurry is nearly equal to the weight of the incoming hot toner slurry by weight i.e. the ratio of the incoming hot toner slurry to the coolant in the external reactor is about 1:1 by weight. The incoming hot toner slurry has a temperature between 80° C. and 84° C. The temperature of the coolant in the external reactor is between 8° C. and 25° C.

BRIEF DESCRIPTION OF THE DRAWINGS

The above-mentioned and other features and advantages of the various embodiments, and the manner of attaining them, will become more apparent and will be better understood by reference to the accompanying drawings.

DETAILED DESCRIPTION

Figure 1:
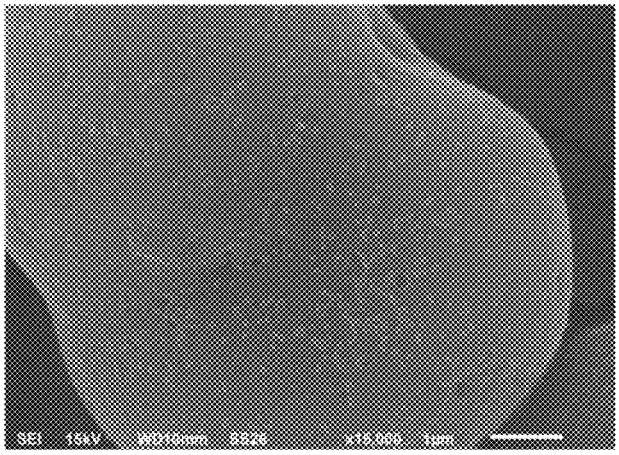
FIG. 1 is a scanning electron microscope image using an oxygen plasma etching technique, following a 3-minute etch time, of a black polyester toner particle prepared using the crash cooling method of the present invention.

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure relates to a method of preparing of crash cooling toner wherein the external reactor used for cooling the hot toner slurry contains a coolant comprising a mixture of a previously cooled toner slurry and cooled de-ionized water. The previously cooled toner slurry in the coolant mixture in the external reactor has the same composition as the incoming hot toner slurry. The ratio of the de-ionized water to the previously crash cooled toner slurry found in the coolant is between 98:2 by weight and 60:40 by weight, preferably about 70:30 by weight. The temperature of the de-ionized water used in the external reactor can be about 8° C. to about 25° C. The amount of coolant used is similar by weight to the hot toner slurry into the external reactor, i.e. a ratio of the incoming hot toner slurry to the coolant in the external reactor is about 1:1 by weight.

The toner is utilized in an electrophotographic printer such as a printer, copier, multi-function device or an all-in-one device. The toner may be provided in a cartridge that supplies toner to the electrophotographic printer. Example methods of forming toner using emulsion aggregation techniques are found in U.S. Pat. Nos. 6,531,254 and 6,531,256, which are incorporated by reference herein in their entirety. U.S. Pat. Nos. 8,669,035 and 9,023,569 disclose example toner formulations and methods of making toner using a borax coupling agent and are assigned to the applicants of the present invention and are incorporated by reference herein in their entirety. Additionally, U.S. Pat. No. 10,108,100 B1 discloses an example toner formulation utilizing a crash cooling process to control the surface domains of crystalline materials. All the above listed issued patents are assigned to the assignee of the present invention and incorporated by reference in their entirety.

In the present emulsion aggregation process, the toner particles are manufactured by chemical methods as opposed to physical methods such as pulverization. Generally, the toner includes one or more polymer binders, a core shell latex, a release agent or wax, a colorant, an optional borax coupling agent and one or more optional additives such as a charge control agent (CCA).

A detailed synthesis of the toner of the present invention is set forth as follows: An emulsion of a polymer binder is formed in water, optionally with organic solvent, with an inorganic base such as sodium hydroxide, potassium hydroxide, ammonium hydroxide, or an organic amine compound. A stabilizing agent having an anionic functional group (A−), e.g., an anionic surfactant or an anionic polymeric dispersant may also be included. It will be appreciated that a cationic (C+) functional group, e.g., a cationic surfactant or a cationic polymeric dispersant, may be substituted as desired.

The polymer latex or a mixture of polymer latex resin systems, colorant, release agent and the optional CCA are dispersed separately in their own aqueous environments or in one aqueous mixture, as desired, in the presence of a stabilizing agent having similar functionality (and ionic charge) as the stabilizing agent employed in the polymer latex. The polymer latex forming the toner core, the colorant dispersion, the release agent dispersion and the optional CCA dispersion are then mixed and stirred to ensure a homogenous composition. As used herein, the term dispersion refers to a system in which particles are dispersed in a continuous phase of a different composition (or state) and may include an emulsion. Acid is then added to reduce the pH and cause flocculation. In this case, flocculation includes the formation of a gel where resin, colorant, release agent and CCA form an aggregate mixture, typically from particles 1-2 microns (μm) in size. Unless stated otherwise, reference to particle size herein refers to the largest cross-sectional dimension of the particle. The aggregated toner particles may then be heated to a temperature that is less than or around (e.g., ±5° C.) the glass transition temperature (Tg) of the polymer latex to induce the growth of clusters of the aggregate particles, to a particle size near the expected toner particle size, i.e. 5-6 microns (μm). Once the aggregate particles reach the desired size of the toner core, the borax coupling agent is added so that it forms on the surface of the toner core. Following addition of the borax coupling agent, the polymer latex forming the toner shell is added. This polymer latex aggregates around the toner core to form the toner shell. Once the aggregate particles reach the desired toner size, base may be added to increase the pH and reionize the anionic stabilizing agent to prevent further particle growth or one can add additional anionic stabilizing agents. The temperature is then raised above the glass transition temperature of the polymer latex(es) to fuse the particles together within each cluster. This temperature is maintained until the particles reach the desired circularity. Once a desired circularity is achieved, the system is cooled.

The crash cooling process of the present invention involves the addition of the hot toner slurry to an equivalent amount of coolant in an external reactor. The coolant in the external reactor comprises about 30% of a toner slurry that was prepared previously in a toner preparation process and diluted with de-ionized water to achieve the required amount of coolant water. The amount or weight of the coolant in the external reactor is equivalent to the amount of incoming hot toner slurry. Additionally, the previously cooled toner slurry in the coolant is the same toner composition as the incoming hot toner slurry. It may be noted that the inventive crash cooling method can be utilized in manufacturing processes that require preparation of several batches of toner and because the coolant comprises about 30% of the toner slurry that was previously washed, it lowers the amount of de-ionized water required in the preparation and cooling of the toner and therefore results in a more environmentally friendly toner manufacturing process. The toner particles are then filtered out of the toner slurry, washed with de-ionized water, and filtered again. This process is repeated until the conductivity of the filtrate reaches a desired value.

The toner particles produced may have an average particle size of between about 3 μm and about 20 μm (volume average particle size) including all values and increments therebetween, such as between about 4 μm and about 15 μm or, more particularly, between about 5 μm and about 7 μm. The toner particles produced may have an average degree of circularity between about 0.90 and about 1.00, including all values and increments therebetween, such as about 0.93 to about 0.98. The average degree of circularity and average particle size may be determined by a Sysmex Flow Particle Image Analyzer (e.g., FPIA-3000) available from Malvern Instruments, Ltd., Malvern, Worcestershire, UK. The various components for the emulsion aggregation method to prepare the above referenced toner will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

As mentioned above, the toners herein include one or more polymer binders. The terms resin and polymer are used interchangeably herein as there is no technical difference between the two. In one embodiment, the polymer binder(s) include styrene-acrylate polymers. In an alternative embodiment, the polymer binder(s) include polyesters. The polyester binder(s) which are amorphous and non-crystalline polyester binder. Alternatively, the polyester binder(s) may include a polyester copolymer binder resin. For example, the polyester binder(s) may include a styrene/acrylic-polyester graft copolymer. The polyester binder(s) may be formed using acid monomers such as terephthalic acid, trimellitic anhydride, dodecenyl succinic anhydride and fumaric acid. Further, the polyester binder(s) may be formed using alcohol monomers such as ethoxylated and propoxylated bisphenol A. Example polyester resins include, but are not limited to, T100, TF-104, NE-1582, NE-701, NE-2141, NE-1569, Binder C, FPESL-2, W-85N, TL-17, TPESL-10, TPESL-11 polyester resins from Kao Corporation, Bunka Sumida-ku, Tokyo, Japan, or mixtures thereof. The polymer binder(s) also includes a thermoplastic type polymer such as a styrene and/or substituted styrene polymer, such as a homopolymer (e.g., polystyrene) and/or copolymer (e.g., styrene-butadiene copolymer and/or styrene-acrylic copolymer, a styrene-butyl methacryla te copolymer and/or polymers made from styrene-butyl acrylate and other acrylic monomers such as hydroxy acrylates or hydroxyl methacrylates); polyvinyl acetate, polyalkenes, poly(vinyl chloride), polyurethanes, polyamides, silicones, epoxy resins, or phenolic resins.

Colorants are compositions that impart color or other visual effects to the toner and may include carbon black, dyes (which may be soluble in a given medium and capable of precipitation), pigments (which may be insoluble in a given medium) or a combination of the two. A colorant dispersion may be prepared by mixing the pigment in water with a dispersant. Alternatively, a self-dispersing colorant may be used thereby permitting omission of the dispersant. The colorant may be present in the dispersion at a level of about 5% to about 20% by weight including all values and increments therebetween. For example, the colorant may be present in the dispersion at a level of about 10% to about 15% by weight. The dispersion of colorant may contain particles at a size of about 50 nanometers (nm) to about 500 nm including all values and increments therebetween. Further, the colorant dispersion may have a pigment weight percent divided by dispersant weight percent (P/D ratio) of about 1:1 to about 8:1 including all values and increments therebetween, such as about 2:1 to about 5:1. The colorant may be present at less than or equal to about 15% by weight of the final toner formulation including all values and increments therebetween.

The wax used may include any compound that facilitates the release of toner from a component in an electrophotographic printer (e.g., release from a roller surface). The term 'release agent' can also be used to describe a compound that facilitates the release of toner from a component in an electrophotographic printer. For example, the release agent or wax may include polyolefin wax, ester wax, polyester wax, polyethylene wax, Fischer-Tropsch wax, metal salts of fatty acids, fatty acid esters, partially saponified fatty acid esters, higher fatty acid esters, higher alcohols, paraffin wax, carnauba wax, amide waxes, natural wax such as Carnauba wax, and polyhydric alcohol esters or mixtures thereof.

The wax or release agent may therefore include a low molecular weight hydrocarbon-based polymer (e.g., Mn≤10,000) having a melting point of less than about 140° C. including all values and increments between about 50° C. and about 140° C. The wax may be present in the dispersion at an amount of about 5% to about 35% by weight including all values and increments there between. For example, the wax may be present in the dispersion at an amount of about 10% to about 18% by weight. The wax dispersion may also contain particles at a size of about 50 nm to about 1 μm including all values and increments there between. In addition, the wax dispersion may be further characterized as having a wax weight percent divided by dispersant weight percent (RA/D ratio) of about 1:1 to about 30:1. For example, the RA/D ratio may be about 3:1 to about 8:1. The wax is provided in the range of about 2% to about 20% by weight of the final toner formulation including all values and increments there between. Exemplary waxes having these above enumerated characteristics include, but are not limited to, SD-A01, SD-B01, MPA-A02, CM-A01 and CM-B01 from Cytech Products, Inc., and Polywax 500 from Baker Petrolite, WE5 from Nippon Oil and Fat and FTX-1 wax from Michelman.

The coupling agent used herein is borax (also known as sodium borate, sodium tetraborate, or disodium tetraborate). As used herein the term coupling agent refers to a chemical compound having the cross-linking ability to bond two or more components together. Typically, coupling agents have multivalent bonding ability. Borax differs from commonly used permanent coupling agents, such as multivalent metal ions (e.g., aluminum and zinc), in that its bonding is reversible. In the electrophotographic process, toner is preferred to have a low fusing temperature to save energy and a low melt viscosity ("soft") to permit high speed printing at low fusing temperatures. However, in order to maintain the stability of the toner during shipping and storage and to prevent filming of the printer components, toner is preferred to be "harder" at temperatures below the fusing temperature. Borax provides cross-linking through hydrogen bonding between its hydroxy groups and the functional groups of the molecules it is bonded to. The hydrogen bonding is sensitive to temperature and pressure and is not a stable and permanent bond. For example, when the temperature is increased to a certain degree or stress is applied to the polymer, the bond will partially or completely break causing the polymer to "flow" or tear off. The reversibility of the bonds formed by the borax coupling agent is particularly useful in toner because it permits a "soft" toner at the fusing temperature but a "hard" toner at the storage temperature.

It has also been observed that borax surprisingly causes fine particles to collect on larger particles. As a result, borax is particularly suitable as a coupling agent between the core and shell layers of the toner because it collects the components of the toner core to the core particle before the shell is added thereby reducing the residual fine particles in the toner. This, in turn, reduces the amount of acid needed in the agglomeration stage and narrows the particle size distribution of the toner.

Borax also serves as a good buffer in the toner formation reaction as a result of the equilibrium formed by its boric acid and conjugate base. The presence of borax makes the reaction more resistant to pH changes and broadens the pH adjusting window of the reaction in comparison with a conventional emulsion aggregation process. The pH adjusting window is crucial in the industrial scale up of the process to control the particle size. With a broader window, the process is easier to control at an industrial scale.

The quantity of the borax coupling agent used herein can be varied. The borax coupling agent may be provided at between about 0.1% and about 5.0% by weight of the total polymer binder in the toner including all values and increments therebetween, such as between about 0.1% and about 1.0% or between about 0.1% and about 0.5%. If too much coupling agent is used, its bonding may not be completely broken at high temperature fusing. On the other hand, if too little coupling agent is used, it may fail to provide the desired bonding and buffering effects.

A surfactant, a polymeric dispersant or a combination thereof may be used. The polymeric dispersant may generally include three components, namely, a hydrophilic component, a hydrophobic component and a protective colloid component. Reference to hydrophobic refers to a relatively non-polar type chemical structure that tends to self-associate in the presence of water. The hydrophobic component of the polymeric dispersant may include electron-rich functional groups or long chain hydrocarbons. Such functional groups are known to exhibit strong interaction and/or adsorption properties with respect to particle surfaces such as the colorant and the polyester binder resin of the polyester resin emulsion. Hydrophilic functionality refers to relatively polar functionality (e.g., an anionic group) which may then tend to associate with water molecules. The protective colloid component includes a water-soluble group with no ionic function. The protective colloid component of the polymeric dispersant provides extra stability in addition to the hydrophilic component in an aqueous system. Use of the protective colloid component substantially reduces the amount of the ionic monomer segment or the hydrophilic component in the polymeric dispersant. Further, the protective colloid component stabilizes the polymeric dispersant in lower acidic media. The protective colloid component generally includes polyethylene glycol (PEG) groups. The dispersant employed herein may include the dispersants disclosed in U.S. Pat. Nos. 6,991,884 and 5,714,538, which are assigned to the assignee of the present application and are incorporated by reference herein in their entirety.

The surfactant, as used herein, may be a conventional surfactant known in the art for dispersing non-self-dispersing colorants and release agents employed for preparing toner formulations for electrophotography. Commercial surfactants such as the AKYPO series of carboxylic acids from AKYPO from Kao Corporation, Bunka Sumida-ku, Tokyo, Japan may be used. For example, alkyl ether carboxylates and alkyl ether sulfates, preferably lauryl ether carboxylates and lauryl ether sulfates, respectively, may be used. One particular suitable anionic surfactant is AKYPO RLM-100 available from Kao Corporation, Bunka Sumida-ku, Tokyo, Japan, which is laureth-11 carboxylic acid thereby providing anionic carboxylate functionality. Other anionic surfactants contemplated herein include alkyl phosphates, alkyl sulfonates and alkyl benzene sulfonates. Sulfonic acid containing polymers or surfactants may also be employed.

The toner formulation of the present disclosure may also include one or more conventional charge control agents, which may optionally be used for preparing the toner formulation. A charge control agent may be understood as a compound that assists in the production and stability of a tribocharge in the toner. The charge control agent(s) also help in preventing deterioration of charge properties of the toner formulation. The charge control agent(s) may be prepared in the form of a dispersion in a manner similar to that of the colorant and release agent dispersions discussed above. The charge control agent may be based on a metal salicylate complex such as Zinc salicylate, Boron salicylate, Aluminum salicylate, etc.

The toner formulation may include one or more additional additives, such as acids and/or bases, emulsifiers, extra particular additives, UV absorbers, fluorescent additives, pearlescent additives, plasticizers and combinations thereof. These additives may be desired to enhance the properties of an image printed using the present toner formulation. For example, UV absorbers may be included to increase UV light fade resistance by preventing gradual fading of the image upon subsequent exposures to ultraviolet radiations. Suitable examples of the UV absorbers include, but are not limited to, benzophenone, benzotriazole, acetanilide, triazine and derivatives thereof.

The following examples are provided to further illustrate the teachings of the present disclosure, not to limit the scope of the present disclosure.

TONER FORMULATION EXAMPLES

Black Polyester Toner Preparation (Comparative Example 1)

In a 50 L reactor was placed about 7.0 parts of Carbon Black dispersion, 11.25 parts of a paraffin wax dispersion, 38.4 parts of a medium Tg (Tg=56° C.) polyester resin emulsion, 11.4 parts of a low Tg (Tg=53° C.) polyester resin emulsion and sufficient water to achieve about 13% solids. De-stabilization of the pigment dispersion, wax dispersion, and latex emulsions were achieved by the addition of an acid such as sulfuric acid, until a pH of about 1.5 to 2.3 is achieved. The destabilization can involve a change in stirring speed to achieve a desired particle size. The temperature was then increased to about 41° C. and held at this temperature for about 45 minutes to about 90 minutes, to achieve a particle size of about 5.0-5.2 μm (volume). Upon reaching the desired particle size, about 2.77 parts of borax dispersion is added followed by stirring for about 5 to 15 minutes. About 28.6 parts of a high Tg (Tg=60° C.) polyester resin emulsion is then added, along with de-ionized water. The reaction mixture is then heated to about 45° C. and stirred until a particle size of about 6.2-6.3 μm is achieved. An aqueous base, such as aqueous sodium hydroxide (5% solution), is then added increase the pH to about 6.75-6.9. The temperature is then increased to about 83° C. and the toner shape is monitored by measuring circularity in a FPIA3000 Sysmex instrument. The particle size is also monitored. On achieving a circularity of about 0.965-0.975, the toner slurry is cooled. The cooling process involves the addition of the hot toner slurry to an external reactor containing an equivalent amount of water at a temperature of about 20° C. The toner particles are then filtered out of the toner slurry, washed with de-ionized water, and filtered again. This process is repeated until the conductivity of the filtrate is less than or equal to about 5 μS/cm. The toner particles are then dried. This cooled toner filtrate having a conductivity of less than or equal to about 5 μS/cm is referred to as 'Cooled Toner Slurry'. This Cooled Toner Slurry will then be used in the inventive crash cooling method described in Black Polyester Toner Preparation (Example 1) herein below. The crash cooling process set forth in Comparative Example 1 is repeated until the required amount of the Cooled Toner Slurry needed for the preparation of the black polyester toner in Example 1 is produced.

Black Polyester Toner Preparation (Example 1)

In a 50 L reactor was placed about 7.0 parts of Carbon Black dispersion, 11.25 parts of a paraffin wax dispersion, 38.4 parts of a medium Tg (Tg=56° C.) polyester resin emulsion, 11.4 parts of a low Tg (Tg=53° C.) polyester resin emulsion and sufficient water to achieve about 13% solids. De-stabilization of the pigment dispersion, wax dispersion, and latex emulsions were achieved by the addition of an acid such as sulfuric acid, until a pH of about 1.5 to 2.3 is achieved. The destabilization can involve a change in stirring speed to achieve a desired particle size. The temperature was then increased to about 41° C. and held at this temperature for about 45 minutes to about 90 minutes, to achieve a particle size of about 5.0-5.2 μm (volume). Upon reaching the desired particle size, about 2.77 parts of borax dispersion is added followed by stirring for about 5 to 15 minutes. About 28.6 parts of a high Tg (Tg=60° C.) polyester resin emulsion is then added, along with de-ionized water. The reaction mixture is then heated to about 45° C. and stirred until a particle size of about 6.2-6.3 μm is achieved. An aqueous base, such as aqueous sodium hydroxide (5% solution), is then added increase the pH to about 6.75-6.9. The temperature is then increased to about 83° C. and the toner shape is monitored by measuring circularity in a FPIA3000 Sysmex instrument. The particle size is also monitored. On achieving a circularity of about 0.965-0.975, the toner hot slurry is cooled. The inventive crash cooling process includes transferring the hot toner slurry from the toner reactor to the external reactor having a coolant including the combination of the Cooled Toner Slurry produced in Comparative Example 1 and de-ionized water. In an example embodiment, the coolant in the external reactor includes a combination of about 70% de-ionized water and about 30% of the Cooled Toner Slurry produced in Comparative Example 1. The amount of the coolant in the external reactor is equivalent to the amount of incoming hot toner slurry. The temperature of the coolant in the external reactor is 20° C. The toner particles are then filtered out of the toner slurry, washed with de-ionized water, and filtered again. This process is repeated until the conductivity of the filtrate is less than or equal to about 5 μS/cm. The toner particles are then dried.

TABLE 1

Characterization of toners

| Toner ID | Volume average particle size (μm) | % Fines | Circularity | Tg Onset $1^{st}/2^{nd}$ Scan | Heat of Fusion $\Delta H_f$ J/g |
|---|---|---|---|---|---|
| Comp. Example 1[1] | 5.90 | 0.20 | 0.973 | 60/54 | 20.4 |
| Example 1[2] | 6.08 | 2.01 | 0.972 | 63/51 | 21.1 |

[1]Prior art cooling process includes adding hot toner slurry to an external reactor having cooled de-ionized water wherein the amount of hot toner slurry is equivalent to the amount of de-ionized water.
[2]Inventive cooling process includes adding hot toner slurry to an external reactor having a coolant including a combination of de-ionized cooled water and an amount of a previously cooled toner slurry that is the same formulation as the incoming hot toner slurry.

Characterization of toners prepared by the prior art cooling method (Comparative Example 1) and the inventive cooling method (Example 1) was carried out. A slight increase in particle size and number of fines (particle size varying from 0.6-2 μm, by number) was observed.

Description of Test Procedures and Test Results

To gain a better understanding of domain size and distribution of a pigment and/or wax on the surface of the aforementioned described example polyester toners, toners were subjected to an etch technique in an oxygen-plasma chamber, followed by studying the surface via a scanning electron microscope (SEM) instrument. Due to differential oxidation rates for various raw materials, such as polyester resin, release wax, and pigment, it is possible to differentiate between each material set. The pigment and wax are crystalline and hence form domains on the surface and bulk of the toner. The etch analysis shown here indicates the presence and distribution of the carbon black pigment on the polyester toner surface, as seen by the white particles on the polyester toner surface. Increasing the etch time, i.e. increasing the exposure of toner to an oxygen-plasma helps oxidize more of the surface and can reveal the distribution of the pigment and/or wax in the bulk. Hence, the technique is useful in identifying any differences related to changes in the processing of a toner particle. Also, the wax particles tend to form a bigger domain in comparison to the pigment and can be observed as "holes" or "divots", particularly at the longer etch time analysis. For illustration purposes, the etch times corresponding to 3-minutes and 9-minutes are shown in this application. A JEOL JSM 6610V Scanning Electron Microscope was used in evaluation of the toner surfaces.

Surface Domains

Figure 2:
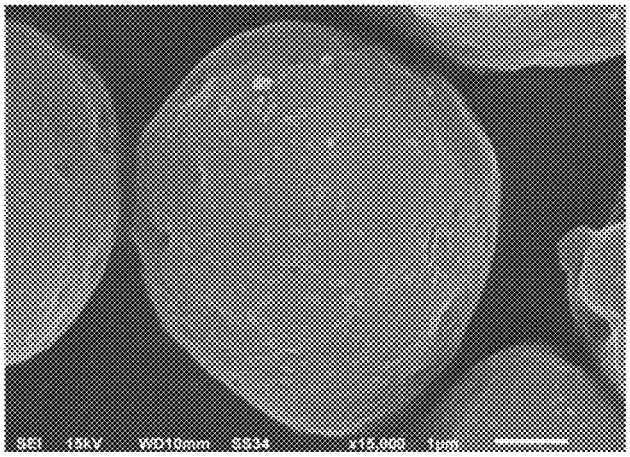
FIG. 2 is a scanning electron microscope image using an oxygen plasma etching technique, following a 3-minute etch time, of a black polyester toner particle prepared using a prior art crash cooling method.
Figure 3:
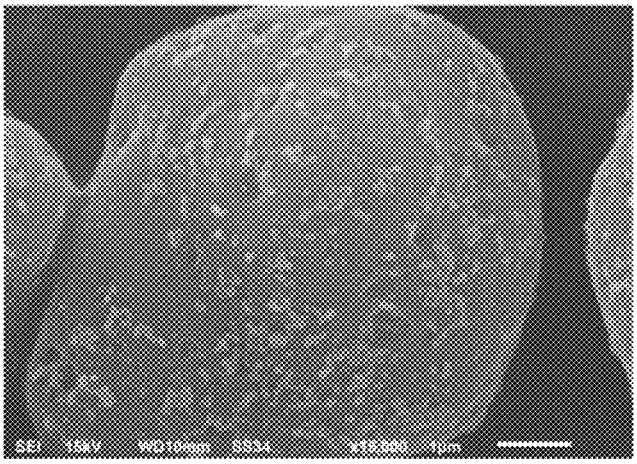
FIG. 3 is a scanning electron microscope image using an oxygen plasma etching technique, following a 9-minute etch time, of a black polyester toner particle prepared using the crash cooling method of the present invention.
Figure 4:
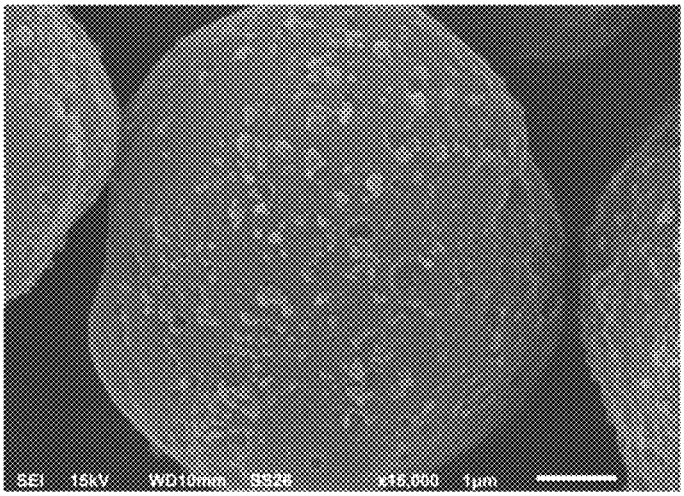
FIG. 4 is a scanning electron microscope image using an oxygen plasma etching technique, following a 9-minute etch time, of a black polyester toner particle prepared using a prior art crash cooling method.

FIGS. 1 and 3 show SEM images following a 3-minute etch and a 9-minute etch, respectfully, of a carbon black polyester toner particle prepared using the inventive crash cooling method wherein hot toner slurry is added to an external reactor having a coolant including the combination of 70% de-ionized water and 30% of a previously cooled toner slurry having the same composition of the incoming hot toner slurry. FIGS. 2 and 4 show SEM images following a 3-minute and a 9-minute etch process, respectfully, using a prior art crash cooling method. In FIGS. 1 and 3 the carbon black pigment, seen as the white particles on the surface, are better distributed in the toner core compared to the distribution of the carbon black pigment as shown in FIGS. 2 and 4. Also, the "holes or voids" seen in the longer etch process in FIGS. 2 and 4 are indicative of areas that had a wax, appear to be similar for both cooling method.

The evaluation of the black toners produced using the inventive crash cooling method and the prior art crash cooling method were done in a Lexmark® CS720 mono component development printer to about 30,000 pages, and data from the test are shown below.

TABLE 2

Comparison of Crash Cooling Methods

| Toner ID | Cooled Toner Slurry/DIW | Toner Charge Q/M (0K/30K) μC/g | DR M/A (0K/30K) mg/cm$^2$ | L* (0K/30K) | Toner Usage (mg/pg) | Print Quality Defects |
|---|---|---|---|---|---|---|
| Comparative Example 1[1] | 0%/100% | −56.1/−36.3 | 0.31/0.35 | 21.7/11.5 | 10.01 | None |
| Example 1[2] | 30%/70% | −59.5/−38.5 | 0.32/0.38 | 23.8/18.5 | 9.86 | None |

Toner Q/M corresponds to charge per unit area in a charge lift off measurement off a toner on a developer roller.

DR M/A corresponds to mass/area on the developer roller following a charge lift-off measurement, measured in mg/cm$^2$

[1]Prior art cooling process includes adding hot toner slurry to an external reactor having cooled de-ionized water wherein the amount of hot toner slurry is equivalent to the amount of de-ionized water.

[2]Inventive cooling process includes adding hot toner slurry to an external reactor having a coolant including a combination of de-ionized cooled water and an amount of a previously cooled toner slurry that is the same formulation as the incoming hot toner slurry.

Toners prepared by the two different cooling methods were evaluated in a Lexmark® CS720 printer to about 30000 pages. The data listed in Table 2 included charge/mass, mass/area and L* as measured at the start of the toner test and at the end of test (30000 pages). Toner usage is calculated as total amount of toner used over 30000 pages and represented as a milligrams of toner per page. In comparison to the Comparative Example 1 Toner, the Example 1 Toner showed a slight increase in toner charge and prints were about 1-2 L* lighter. However, performance through life was better for the Example 1 Toner, with smaller changes observed through 30000 pages. Also, toner usage over 30K pages was less for Example Toner 1 compared to Comparative Toner 1. No print quality defects were observed in Example 1 Toner.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. A method for producing a core shell toner, comprising:

combining and agglomerating a polymer emulsion with a colorant dispersion and a release agent dispersion to form toner cores;

adding a borax coupling agent to the toner cores once the toner cores reach a predetermined size;

combining and agglomerating a second polymer emulsion with the toner cores to form toner shells around the toner cores;

fusing the aggregated toner cores and toner shells to form toner particles;

forming a hot toner slurry by suspending the toner particles in an aqueous medium wherein the hot toner slurry has a temperature between 70° C. and 90° C.;

adding the hot toner slurry into an external reactor containing a coolant having a temperature between 8° C. and 20° C., wherein the coolant contains a mixture of de-ionized water and a cooled toner slurry having the same composition as the hot toner slurry being added into the external reactor;

filtering the toner particles out of the hot toner slurry;

washing the filtered toner particles with deionized water; and repeating the filtering and washing steps until the conductivity of the filtered toner particles less than or equal to 5 μS/cm.

2. The method of claim 1, wherein the ratio of the de-ionized water to the cooled toner slurry in the coolant is between 98:2 and 60:40.

3. The method of claim 1, wherein the ratio of the de-ionized water to the cooled toner slurry in the coolant is 70:30.

4. The method of claim 1, wherein the ratio of the hot toner slurry being added into the external reactor to the coolant in the external reactor is 1:1 by weight.

5. The method of claim 1, wherein the hot toner slurry has a temperature between 80° C. and 84° C.

6. The method of claim 1, wherein the first polymer emulsion and the second polymer emulsion each include an amorphous resin.

7. A toner prepared by the process of claim 1.

* * * * *